US010219327B2

(12) United States Patent
Frank et al.

(10) Patent No.: US 10,219,327 B2
(45) Date of Patent: Feb. 26, 2019

(54) METHOD FOR TEMPERATURE DETERMINATION

(71) Applicant: E.G.O. Elektro-Geraetebau GmbH, Oberderdingen (DE)

(72) Inventors: Marcus Frank, Oberderdingen (DE); Elmar Herweg, Oberderdingen (DE); Marius Lehner, Muehlacker (DE); Michael Stober, Oberderdingen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 265 days.

(21) Appl. No.: 15/246,646

(22) Filed: Aug. 25, 2016

(65) Prior Publication Data

US 2017/0064776 A1 Mar. 2, 2017

(30) Foreign Application Priority Data

Aug. 27, 2015 (DE) ..... 10 2015 216 455

(51) Int. Cl.
*H05B 6/08* (2006.01)
*H05B 6/12* (2006.01)
*H05B 6/06* (2006.01)

(52) U.S. Cl.
CPC ..... *H05B 6/065* (2013.01); *H05B 2213/03* (2013.01); *H05B 2213/07* (2013.01)

(58) Field of Classification Search
CPC . H05B 6/065; H05B 2213/03; H05B 2213/07
(Continued)

(56) References Cited

U.S. PATENT DOCUMENTS 7,423,244 B2 9/2008 Baier et al.
2009/0314769 A1* 12/2009 Bonnel ..... H05B 3/746 219/627

(Continued)

FOREIGN PATENT DOCUMENTS

DE 195 40 408 A1 5/1997
DE 10 2009 047 185 A1 6/2011

(Continued)

OTHER PUBLICATIONS

European Patent Office, Extended European Search Report for Application No. 16184674.6, dated Jan. 23, 2017, 6 pages, Germany.

*Primary Examiner* — Hung D Nguyen
(74) *Attorney, Agent, or Firm* — Alston & Bird LLP

(57) ABSTRACT

To determine the temperature of boiling water in an induction hob including induction heating coils which can be individually driven and which, in a common heating mode, form a cooking point for a cooking vessel containing water, the cooking vessel is positioned over at least two induction heating coils. The induction heating coils are operated in the heating mode to bring the water in the cooking vessel to boil and each induction heating coil heats that region of the cooking vessel base arranged above it. During the heating mode, the oscillation response at each induction heating coil is used to detect whether temperature of the region of the cooking vessel base above this induction heating coil increases. The induction heating coils are operated in the heating mode until one induction heating coil detects that the temperature gradient of the cooking vessel base above the induction heating coil has reached zero.

13 Claims, 2 Drawing Sheets

(58) Field of Classification Search
USPC ... 219/395, 441, 443.1, 448.1, 447.1, 462.1, 219/620, 621, 622, 624, 627, 662, 667, 219/671, 672, 675, 626, 665
See application file for complete search history.

(56) References Cited

U.S. PATENT DOCUMENTS

| | | | | |
|---|---|---|---|---|
| 2011/0120989 | A1 | 5/2011 | Schilling et al. | |
| 2013/0075388 | A1 | 3/2013 | Schilling et al. | |
| 2013/0078346 | A1 | 3/2013 | Schilling et al. | |
| 2014/0158678 | A1 | 6/2014 | Thomann et al. | |
| 2015/0034630 | A1* | 2/2015 | Fuchs ..... | H05B 6/065 219/667 |
| 2015/0341990 | A1 | 11/2015 | Nagata et al. | |
| 2016/0037584 | A1 | 2/2016 | Viroli et al. | |

FOREIGN PATENT DOCUMENTS

| | | | |
|---|---|---|---|
| DE | 10 2011 083 383 | A1 | 3/2013 |
| DE | 10 2011 083 397 | A1 | 3/2013 |
| EP | 1 463 383 | B1 | 9/2004 |
| EP | 2 330 866 | A2 | 6/2011 |
| EP | 2574143 | A2 | 3/2013 |
| EP | 2 779 787 | A1 | 9/2014 |
| EP | 2911473 | A1 | 8/2015 |
| JP | 2005-310517 | A | 11/2005 |
| WO | WO-2012/092683 | A2 | 7/2012 |

* cited by examiner

METHOD FOR TEMPERATURE DETERMINATION

CROSS-REFERENCE TO RELATED APPLICATIONS

This application claims priority to German Application No. 10 2015 216 455.1, filed Aug. 27, 2015, the contents of which are hereby incorporated herein in its entirety by reference.

TECHNOLOGICAL FIELD

The invention relates to a method for temperature determination in an induction hob comprising a plurality of induction heating coils.

BACKGROUND

US 2011/120989 A1 discloses detecting the temperature of the cooking vessel base at an induction heating coil during a heating mode of the induction heating coil for a cooking point for a cooking vessel containing water, primarily in order to determine when water in the cooking vessel is boiling. An oscillation response of the induction heating coil is detected and evaluated for this purpose.

EP 1463383 B1 discloses forming a cooking point for a cooking vessel by way of a plurality of induction heating coils, which can each be individually driven, in a common heating mode in an induction hob. In this case, it is possible to use the induction heating coils themselves or other identification means to identify that the cooking vessel is covering these induction heating coils to a sufficient extent in each case. Therefore, it is possible, to a certain extent, to match the size of a cooking point to the size of a cooking vessel which is heated by it.

BRIEF SUMMARY

The invention is based on the problem of providing a method of the kind cited in the introductory part with which problems encountered in the prior art can be solved and it is possible, in particular, to carry out the temperature determination in the cooking vessel in an advantageous and accurate manner, in particular to determine when water in the cooking vessel is boiling.

This problem is solved by a method. Advantageous and preferred refinements of the invention are the subject matter of the further claims and will be explained in greater detail in the text which follows. The wording of the claims is incorporated in the content of the description by express reference.

The following steps are carried out in the method which is carried out in an induction hob comprising a plurality of induction heating coils which can be individually driven.

A cooking vessel containing water or a liquid which mainly contains water is positioned on the induction hob such that it covers at least two induction heating coils. The cooking vessel advantageously covers three to five induction heating coils which, in this case, are designed to be correspondingly small, for example with diameters or widths in the range of between 6 cm and 18 cm. These induction heating coils identify coverage by the cooking vessel, in particular to a previously defined extent or with a predefined degree of coverage, for example at least 50% of the surface area of the induction heating coil. These induction heating coils which are correspondingly covered are then jointly operated as a joint cooking point, specifically in the heating mode or for the cooking process in order to bring the water in the cooking vessel to boil by heating. According to the invention, this boiling of the water is intended to be detected as temperature determination.

During the heating mode which then follows, each induction heating coil heats, in a known manner, that region of the cooking vessel base which is arranged above it. In this case, energy is input into the lowermost region of the cooking vessel base, usually the lowermost 1 mm to 2 mm. From there, the heat spreads upwards to the top face of the cooking vessel base and from there is transferred to the water. In this case, the induction heating coils of a cooking point advantageously operate with the same power level or resulting surface area power density of the power which is transmitted into the vessel.

During the heating mode, the oscillation response at least one induction heating coil is used to detect whether the temperature of the cooking vessel base above this induction heating coil changes or whether this temperature increases. Therefore, a temperature gradient of the cooking vessel base can be detected by the induction heating coil, this preferably being performed in accordance with a method as is described in US 2011/120989 A1 which is cited in the introductory part. The content of the document is hereby included in the content of the present application by express reference in this respect. If this determination of the oscillation response takes place only periodically, it should be done approximately once per second, advantageously every 0.1 seconds to 2 seconds. In general, the oscillation response of an induction heating coil can be understood to be the evaluation of the change in resonant circuit parameters on account of changes in the temperature of the cooking vessel base, in particular the changing inductance. The oscillation response of each induction heating coil can preferably be detected. The induction heating coils are operated in the heating mode at least until an induction heating coil detects that the temperature gradient of the cooking vessel base above it is close to zero or has reached zero.

A temperature of a cooking vessel base which is heated by means of an induction heating coil is advantageously ascertained in the heating mode. The method comprises the following steps: generating an intermediate circuit voltage at least temporarily depending on a single-phase or poly-phase, in particular three-phase, supply system AC voltage, generating a high-frequency drive voltage or a drive current from the intermediate circuit voltage, for example with a frequency in a range of from 20 kHz to 70 kHz, and applying the drive voltage or the drive current to a resonant circuit comprising the induction heating coil. The cooking vessel base is conventionally inductively heated in this way. The following steps are carried out for the purpose of temperature measurement: generating the intermediate circuit voltage during prespecified time periods, in particular periodically, at a constant voltage level, wherein the intermediate circuit voltage is preferably generated independently of the supply system AC voltage during the time periods, generating the drive voltage during the prespecified time periods in such a way that the resonant circuit oscillates at its natural resonant frequency in a substantially deattenuated manner, measuring at least one oscillation parameter of the oscillation during the predefined time periods, and evaluating the at least one measured oscillation parameter in order to ascertain the temperature. Since the intermediate circuit voltage is kept constant during the temperature measurement operation, signal influences on account of a variable intermediate circuit voltage can be eliminated, as a result of which the temperature can be determined reliably and without interference.

In one development, the method comprises the following steps: determining zero crossings of the supply system AC voltage and selecting the time periods in the region of the zero crossings. In the case of a single-phase supply system AC voltage, the intermediate circuit voltage usually drops severely in the region of the zero crossings. The constant voltage level is preferably selected in such a way that it is greater than the voltage level usually established in the region of the zero crossings, so that the intermediate circuit voltage is clamped at the constant voltage level in the region of the zero crossings. Constant voltage conditions, which enable reliable temperature measurement, then prevail in the region of the zero crossings.

The induction heating coils are all operated in the heating mode at least until a first induction heating coil detects that the temperature gradient of the region of the cooking vessel base above this induction heating coil has reached zero. It is also possible for all of the induction heating coils to be operated in the heating mode until the temperature gradient of the cooking vessel base which is located above each of the induction heating coils has reached zero. When the temperature gradient has reached zero, this means that the temperature of the cooking vessel base does not increase any further, this in turn meaning that the water in the cooking vessel directly above this cooking vessel base region or at the interface between water and cooking vessel base is boiling, that is to say the temperature does not increase further. However, it has been found within the scope of the invention that, specifically when inductively heating a cooking vessel containing water with very high powers being introduced into the cooking vessel base, the intention of this being to result in very rapid boiling of the water, the temperature of the water directly at the cooking vessel base can increase very rapidly to 100° C., at least in regions. In the regions, steam bubbles, which are sometimes very large, are also already released, this being typical of boiling, that is to say the water is boiling or bubbling in the regions. However, not all of the water in the cooking vessel has necessarily reached the temperature of 100° C. yet, but this is actually desired. In addition, because a very high power can be established for initial boiling in induction hobs with the known boost function, steam bubbles are already formed and released when the temperature of the water in the upper region remote from the interface between water and cooking vessel base is only approximately 80° C. to 90° C., that is to say is still clearly far from boiling and the corresponding 100° C. Therefore, temperature differences between the water temperature and the pot base inner face of approximately 10° C. to 40° C. are produced at high heating currents, for example approximately 10 $W/m^2$. In addition, the cooking vessel base has a further temperature difference of approximately 10° C. between inner face and outer face.

Accordingly, the invention determines at least one of the induction heating coils to be a measuring coil. A plurality of methods, which will be discussed in greater detail below, can be used for this purpose.

This measuring coil is then operated in the measuring mode and no longer in the heating mode, wherein it is not absolutely necessary to change or stop the heating mode immediately after a coil is determined to be a measuring coil. In the measuring mode itself, the measuring coil is operated with a so-called measuring power of 10% or 20%, advantageously at most 50%, of the maximum power for a short time, in particular only for half a cycle, and accordingly transmits little or less energy into the region of the cooking vessel base which is situated above the measuring coil. Up to 20% of the measuring power can be considered to be a low power. The measuring coil then detects the fed-back oscillation response in the abovementioned manner. The time profile of this oscillation response is then evaluated after several coupling-in operations of the low energy, that is to say a similar method to that which was already previously applied when detecting the oscillation response at each induction heating coil is substantially applied. The water in the cooking vessel, specifically all of the water, is then determined to be boiling in the event that the gradient of this time profile has reached zero.

In this case, it is not absolutely necessary for the oscillation response to actually be detected at each induction heating coil. Specifically, under certain circumstances, the measuring coil can already be determined in advance, for example to be that induction heating coil with the lowest degree of coverage or the poorest power input into the cooking vessel base. In this case, it is only necessary for the oscillation response of the induction heating coil to be evaluated.

Specifically, the invention substantially has the effect that the measuring coil no longer heats the cooking vessel base and as a result it is, as it were, more easily possible for the true temperature of the water in the cooking vessel to be detected in the region of the cooking vessel base above the measuring coil, and the heating current through the pot base and the heating current at the transition between pot base and water are negligibly small and as a result the true temperature of the water and the temperature of the cooking vessel inner face and bottom face are identical. The above-described temperature differences, connected in series, of approximately 10° C. to 40° C. between cooking vessel inner face and water and approximately 10° C. between cooking vessel inner face and outer face are approaching zero. Owing to the formation of bubbles in the water at the cooking vessel base which has already started, the water in the cooking vessel is thoroughly mixed to a certain extent, in particular due to the rising water. Although this is not sufficient to bring all of the water in the cooking vessel to boil very rapidly since somewhat cooler water is continuously carried over to the cooking vessel base in order to be heated on account of the removal of heat, it is highly probable that there is somewhat cooler water in the unheated region of the cooking vessel base above the measuring coil, specifically both on account of the lack of heating and also on account of the thorough mixing of the water in the cooking vessel. Therefore, an effect which corrupts the measurement result is prevented by stopping the heating mode of the measuring coil. The measuring coil continues to operate only as a kind of sensor for at least a certain time after being determined to be a measuring coil. Coupling-in a signal or a power for generating the oscillation response for the evaluation thereof can be considered to be negligible in respect of heating of the region of the cooking vessel base directly above the measuring coil.

Therefore, an important core feature of the invention is that of making temperature determination in a method for boiling water in a cooking vessel, for which a plurality of induction heating coils are used, more accurate by one of the induction heating coils being used as a measuring coil and, to this end, then no longer operating in the heating mode but rather only in the measuring mode. In this way, corruption of the measurement result is avoided or at least greatly reduced. Although the total heating power for the cooking vessel is reduced in this way, the accuracy increases. Firstly, it is possible to rapidly change over the measuring coil from the heating mode to the measuring mode, for example after it or possibly also another induction heating coil has for the first time detected a temperature of 100° C. at the cooking vessel base on account of the temperature gradient of the oscillation response having reached 0. However, since, as shown by experience, the majority of the water contained in the cooking vessel is still not boiling or has not yet reached 100° C. in this case, it is secondly considered to be reasonable and, in particular, advantageous to also continue to operate the measuring coil in the heating mode for a certain rather short time, for example 10 seconds to 60 seconds or even 300 seconds. Specifically, it can generally be expected that the entire quantity of water will then soon reach 100° C. or the boiling state. Variants, which will be explained in greater detail below, are also possible for this purpose.

In a refinement of the invention, it is possible for that induction heating coil of which the temperature gradient of the oscillation response reaches zero first during the general heating mode and primarily also during its own heating mode to be determined to be a measuring coil. In this case, the measuring coil is, as it were, the induction heating coil with that region of the cooking vessel base which is hottest at this point in time above it. As an alternative to this, that induction heating coil in which this temperature gradient reaches zero last can also be determined to be, and can be used as, a measuring coil. In this case, the measuring coil is accordingly that induction heating coil which has the coolest region of the cooking vessel base above it. In this case, it can be assumed that all of the water in the cooking vessel is already considerably closer to the state in which all of the water is boiling or all of the water is at approximately 100° C. Whereas a relatively long duration of the heating mode until all of the water is boiling, for example 20 seconds to 40 seconds, can still be expected in the case of the first alternative, only a shorter time, for example 5 seconds to 20 seconds, can be expected in the case of the second alternative. This should be noted for the further possible procedures for the temperature determination and for the operation of the induction heating coils.

In a further refinement of the invention, it is possible to determine that induction heating coil which has the lowest power input into the cooking vessel and/or which has the lowest degree of coverage by the cooking vessel to be a measuring coil. The first criterion can be ascertained during the heating mode and, for example, can also be repeatedly or permanently checked. The second criterion can be determined as early as at the beginning of the cooking process, that is to say when it is determined which induction heating coils are covered by the cooking vessel and accordingly start, as joint cooking point, with the heating mode. However, in this case, this criterion should also be checked during the heating mode since it is entirely possible for the cooking vessel above the induction heating coils or on the cooking point to be moved and then for the degree of coverage of individual induction heating coils or all of the induction heating coils to change.

In an advantageous refinement of the invention, all of the induction heating coils are of identical design, that is to say primarily also of the same size. This simplifies production of an induction hob. Furthermore, it is advantageously also possible for all of the induction heating coils, which together form a cooking point for a single cooking vessel, to be operated in an identical manner. This applies primarily for the power level. Therefore, induction heating coils with an identified lower degree of coverage can also be operated just like induction heating coils with a high or complete degree of coverage.

In a refinement of the invention, it is possible, after the first induction heating coil has or detects a temperature gradient which has reached zero, for the heating mode of all of the induction heating coils, which operate for this cooking vessel or this cooking point, to be continued for a certain time at a constant power. This time should be less than 1 minute, and can be, for example, at least 10 seconds, advantageously at least 20 seconds. The previously determined measuring coil is then operated in the measuring mode, advantageously with the abovementioned measuring power, after this time elapses. Here, it is therefore taken into account that, in the case already mentioned above of the first point of the cooking vessel base being at a temperature of approximately 100° C., the measuring coil, which either has already been determined above or is determined only in this way, is not immediately moved from the heating mode since the total heating power at the cooking point would then be unnecessarily reduced. On account of continued heating of all of the induction heating coils, in particular also the measuring coil, heating at the maximum possible power is continued for the purpose of rapid heating since it can be assumed that the water in the cooking vessel has not yet reached 100° C. The measuring coil is then operated in the measuring mode only after a certain time since it can therefore only then be expected that all of the water will soon reach 100° C. This time can also be varied depending on how much water has to be brought to boil and/or on the size of the cooking vessel. To this end, it is possible, for example, for the preceding duration to be used as a criterion when the first induction heating coil detects the temperature gradient which has reached zero.

In another refinement of the invention, the first induction heating coil cannot be used, but rather the last induction heating coil, of which the temperature gradient has reached zero, can be used. In this case too, the measuring coil itself can once again continue to operate in the heating mode for a certain time since, even in this case of the cooking vessel base being at 100° C. overall, it is highly probable that not all of the water in the cooking vessel is at 100° C. yet. This time for the continued operation of the measuring coil in the heating mode should be considerably shorter than 1 minute and can, in particular, be shorter than the abovementioned time, for example 5 seconds to 20 seconds. In this case too, the measuring coil is once again operated in the measuring mode only after this time has elapsed, wherein the coil can once again have been determined to be a measuring coil either as early as at the beginning of the heating mode or only later in this case too.

It is advantageously possible, when the power of the measuring coil has been considerably reduced or is still only operated as a measuring coil with the measuring power, to set the time profile of the water temperature of the water in the cooking vessel equal to the time profile of the cycle duration of the oscillation response at the measuring coil, at least in respect of the relative profile. In this case, this measuring coil operates specifically as a temperature sensor for that region of the cooking vessel base which is situated above it, the region in turn determining the temperature of the water, which is passed over it due to eddying, in the cooking vessel. This region of the cooking vessel base then operates, as it were, as a first part of a sensor. The measuring coil, which as it were checks the temperature of this first part, operates as the second part of this sensor.

The measuring mode of the measuring coil should advantageously be such that it does not introduce any additional heating power into that region of the cooking vessel base which is situated above it, in order to reduce or as far as possible to entirely avoid corruption during temperature detection or temperature determination. As has already been briefly mentioned above, half a cycle can be sufficient for the power input, this, in turn, then being possible only with an abovementioned low power or measuring power.

It is possible, after it is identified that the water in the cooking vessel is boiling, for the power of the induction heating coils or of the cooking point to be reduced in order to prevent the water from boiling over. This reduction may be a reduction by at least 10% to 20%, advantageously even by at least 50% to 70%.

These and further features can be gathered not only from the claims but also from the description and the drawings, wherein the individual features can be realized in each case on their own or as a plurality in the form of subcombinations in an embodiment of the invention and in other fields, and can constitute embodiments which are advantageous and which are protectable per se and for which protection is claimed here. The subdivision of the application into individual sections and subheadings does not restrict the statements made under them in terms of their general validity.

BRIEF DESCRIPTION OF THE SEVERAL VIEWS OF THE DRAWINGS

Exemplary embodiments of the invention are illustrated schematically in the drawings and will be explained in greater detail below. In the drawings.

DETAILED DESCRIPTION

Figure 1:
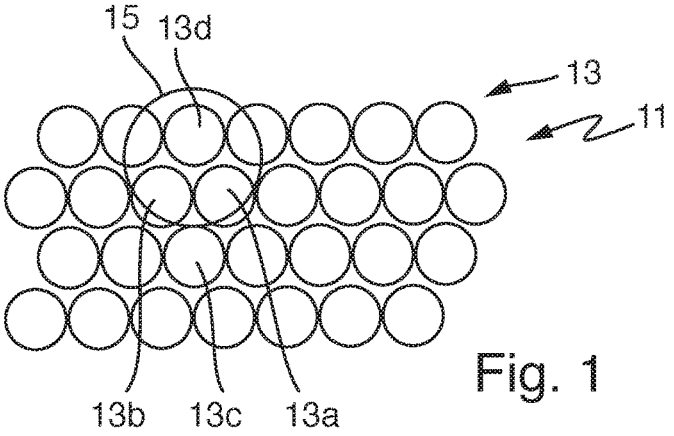
FIG. 1 shows a schematic view of an arrangement of a plurality of induction heating coils of an induction hob with a cooking vessel positioned on it.

FIG. 1 schematically shows how a large number of individual induction heating coils 13, here with a round shape, can be provided in an induction hob 11. This is known from the abovementioned document EP 1463383 B1. A cooking vessel 15 is positioned on the hob, specifically in such a way that it covers more than 50% of four induction heating coils 13*a* to 13*d*. The induction heating coils 13*b* and 13*d* are completely covered, and approximately 70% to 80% of the induction heating coils 13*a* and 13*c* is covered. Induction heating coils to the left and to the right of the induction heating coils 13*d* are also covered to a slight extent. However, this degree of coverage is so slight that this is identified and the induction heating coils are definitively not used as cooking point for the cooking vessel 15 in the heating mode.

Figure 2:
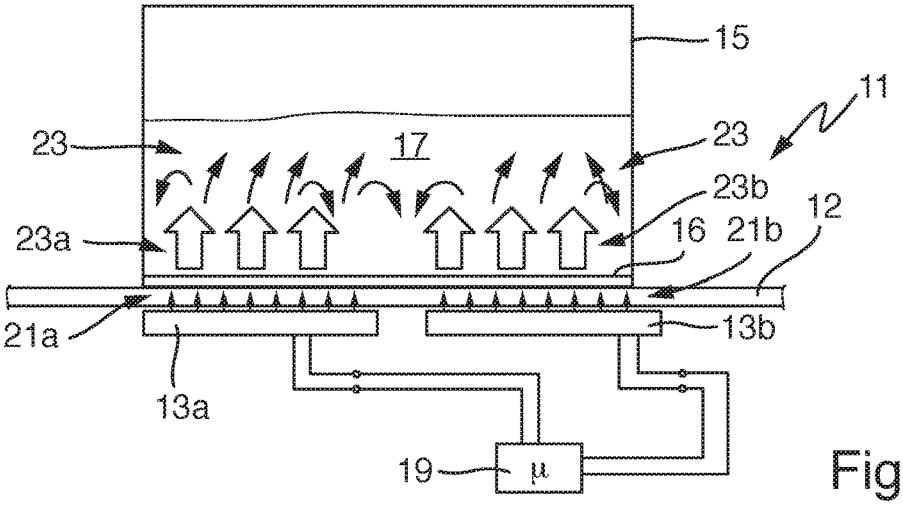
FIG. 2 shows a schematic side view of heating of the cooking vessel from FIG. 1 with the induction heating coils situated beneath it, wherein two induction heating coils operate in the heating mode, together with water currents which are produced.

The side view in FIG. 2 of the induction hob 11 according to the invention comprising a hob plate 12 shows how the two induction heating coils 13*a* and 13*b* are situated beneath the cooking vessel 15 and, respectively, how the cooking vessel is positioned on the hob plate 12 above the induction heating coils. The induction heating coils 13*c* and 13*d* are not shown in the figure, but the same substantially applies to them. The cooking vessel 15 has a cooking vessel base 16 which is suitable for inductive heating and usually has a thickness of a few millimeters, for example 4 mm to 10 mm. A cooking vessel base 16 of this kind is generally of multi-layered design with a topmost layer which is composed of the same material as the side wall of the cooking vessel 15 and is usually produced by deep-drawing, that is to say with an integral material transition. A heat-distributing layer which is composed of copper and has a thickness of a few millimeters is often arranged beneath the topmost layer. A thin layer of stainless steel, which is likewise suitable for inductive heating, can in turn be provided beneath the heat-distributing layer. The thickness of the thin layer can be 1 mm to 2 mm at most. At the same time, this is approximately the maximum penetration depth of inductive fields, which will be explained further below.

The induction heating coils 13*a* and 13*b* are connected to a controller 19 of the induction hob 11 and are supplied with power in a manner driven by means of the controller, usually by means of a power section, not illustrated here, or corresponding resonant circuit arrangements.

Thin arrows each show a power input 21*a* and 21*b* from each of the induction heating coils 13*a* and 13*b* into the cooking vessel 15 or into the cooking vessel base 16. This is known to a person skilled in the art and therefore does not need to be discussed in further detail. As mentioned above, the penetration depths of the power input 21 is less than 2 mm, advantageously less than 1 mm. The heat which is produced is distributed from this lowermost layer of the cooking vessel base 16 upwards through the further structure of the cooking vessel base 16, under certain circumstances with a corresponding transverse distribution. At the top face of the cooking vessel base 16, heat is transferred to water 17 which is located above the cooking vessel base in the cooking vessel 15. Owing to the heat which is introduced, this heated-up water rises, this being indicated by the wide arrows. It goes without saying that the water currents 23*a* and 23*b*, here also further illustrated by further water currents 23, are thoroughly mixed.

Figure 4:
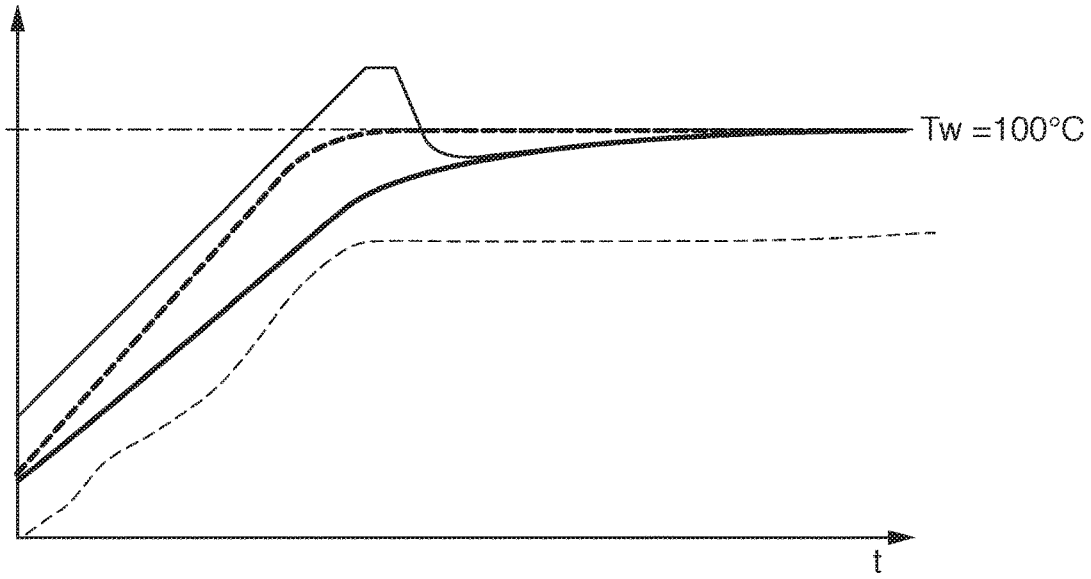
FIG. 4 shows an illustration of profiles both of the water temperature at two points in the cooking vessel and also of signals of an induction heating coil firstly in the heating mode and secondly in the measuring mode.

FIG. 4 shows a graph, which is to be schematically understood, with a thick solid line indicating the temperature $T_W$ of the water 17 in the cooking vessel 15 as a kind of average temperature, that is to say not only measured at individual discrete points but rather as an average at a large number of points. In particular, the temperature can also be a temperature at the water surface, where the temperature of the water 17 is usually the lowest during boiling.

The thick dashed line illustrates the temperature of the water above the left-hand-side induction heating coil 21*a* close to the cooking vessel base 16. The water 17 will be the hottest and boil the quickest here. The value of 100° C. is also indicated for the temperature of the water 17. The profile levels are approximately to scale in relation to one another in the case of the water temperatures illustrated by thick lines.

The thin solid line illustrates the measurement value cited in the introductory part or the cycle signal of that induction heating coil 13*b* which is used as a measuring coil in the measuring mode. The dashed thin line illustrates the cycle signal of the induction heating coil 13*a* which is operated in the heating mode. The magnitude of these two cycle signals must not differ from one another in absolute terms, this difference being illustrated here only for reasons of clarity in order to better show their relative profiles. In particular, the cycle signals can be largely congruent, primarily at the start.

In order to carry out the method according to the invention, after the cooking vessel 15 is placed onto the induction hob 11 and, respectively, over the induction heating coils 13, the controller 19 detects, in a known manner, which of the induction heating coils are actually covered and the extent to which the induction heating coils are covered or the degree of coverage of the induction heating coils. In the case of the induction heating coils 13 of the configuration in FIG. 1, the abovementioned induction heating coils 13*a* to 13*d* are sufficiently covered. If an operator has now selected a power level for the operation of the induction hob 11 with which the water 17 in the cooking vessel 15 is intended to be brought to boil as rapidly as possible, the heating mode of the four induction heating coils 13*a* to 13*d* starts. In this case, the four induction heating coils form a joint cooking point. The four induction heating coils can be operated at the maximum power, in particular a boost power which is known for induction heating coils. This is illustrated in FIG. 2, the induction heating coils 13*a* and 13*b* generate a power input 21*a* and 21*b* in the cooking vessel base 16, in particular in the lowermost layer of the cooking vessel base. The inductively generated heat spreads upwards and enters the water 17 at the top face of the cooking vessel base 16 or is transferred there. This produces water currents 23, in particular powerful water currents 23*a* and 23*b* which rise from the top face of the cooking vessel base 16.

According to a first variant of the method, the induction heating coil 13*b* can now be determined to be a measuring coil since it has the lowest identifiable degree of coverage by the cooking vessel 15 or the cooking vessel base 16. This determination can be performed even when the measuring coil 13*b* is also operated together with the others in the heating mode as a cooking point. As an alternative, the cycle signal, which is illustrated using a dashed line in FIG. 4 and which will run relatively uniformly for most of the induction heating coils at the beginning, can be evaluated for each induction heating coil 13. Then, that induction heating coil in which the gradient first reaches approximately zero can be determined to be a measuring coil and change over to the measuring mode. In a yet further refinement of the invention, that induction heating coil in which this profile becomes constant or has a gradient of zero last in comparison to the other induction heating coils can be used as a measuring coil in the measuring mode.

In the exemplary embodiment described here, this situation of the gradient having reached zero last applies to induction heating coil 13*b*. This means that the temperature is higher or was already high earlier above all of the other induction heating coils 13 of the cooking point.

At the same time, FIG. 4 shows how the water temperature, illustrated using a dashed line, likewise reaches the illustrated maximum value of 100° C. as water temperature at the time at which the increase in the cycle signal of one of the induction heating coils reaches zero. In particular, this is the temperature of the water just above the cooking vessel base 16 over precisely the induction heating coil with the profile, illustrated using a dashed line, of the cycle signal. Owing to the water temperature, which no longer increases, at 100° C., the cooking vessel base 16 can no longer be further heated in this region, and therefore the cycle signal at the induction heating coil no longer increases further either. The thick solid line as temperature $T_W$ of the water 17 in the cooking vessel 15 increases approximately constantly after a short delay at the start. Owing to the changeover of an induction heating coil as a measuring coil, the introduced power is reduced and the slope then becomes flatter.

The induction heating coil 13*b* which is now operated in the measuring mode as a measuring coil with the measuring power has the solid profile with the thin line. The measuring power is, for example, 5% of the maximum power. The profile of the cycle signal at the measuring coil 13*b* also shows that, after the changeover to the measuring mode, this measuring coil transmits virtually no more energy into the cooking vessel base and therefore does not attempt to heat the cooking vessel base any further. Since the water 17 which is located in the cooking vessel 15 is still not at 100° C. overall, that is to say is not yet all boiling, but rather is only at 80° C. to 90° C. for example, this relatively cooler water drops back down to this region of the cooking vessel base and cools it down to less than 100° C. Therefore, the cooking vessel base is cooled in comparison to the previous heating mode of the measuring coil 13*b*. This can be identified by the illustrated drop in the cycle signal of the measuring coil. After a certain time, for example 10 seconds to 30 seconds, this region of the cooking vessel base is at the temperature of the relatively cooler water which is flowing down, and therefore the cycle signal of the measuring coil also runs virtually identically to the water temperature. For reasons of better understanding, this is illustrated jointly and, respectively, congruently here, but this does not have to be the case.

Figure 3:
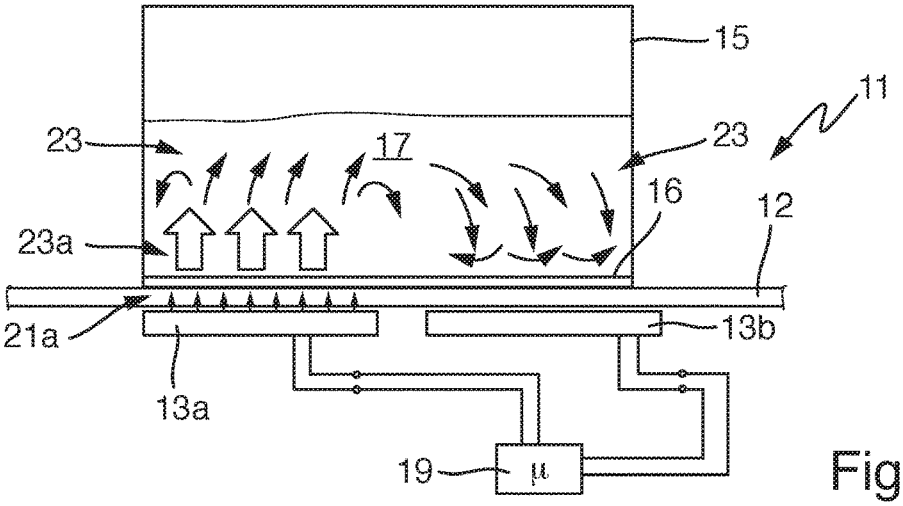
FIG. 3 shows a modification to the illustration from FIG. 2, wherein one induction heating coil operates in the heating mode and one operates in the measuring mode, together with water currents which are produced.

At the same time, it can be seen how the temperature, illustrated using a dashed line, of the water remains at 100° C., for example, above the induction heating coil 13*a* according to FIGS. 2 and 3 which continues to operate in the heating mode. The temperature cannot become any higher, and finally energy is further input by the heating coil. Therefore, the temperature remains, as it were, at the upper limit.

The states in the cooking vessel 15 during this period of time are shown in FIG. 3. The induction heating coil 13*a* in the heating mode continues to effect the power input 21*a* into the cooking vessel base 16 above it, this generating the powerful water current 23*a*. This water current circulates as it were and causes water 17 which is located in the upper region to move downwards and strike that region of the cooking vessel base 16 which is situated above the measuring coil 13*b* in the form of water current 23, which is illustrated by thin arrows. By changing the mode of the induction heating coil 13*b* from the heating mode to the measuring mode, in which the induction heating coil then couples almost no more power into the cooking vessel base, almost 25% of the heating power is lost anyway. Since the aim of the method according to the invention is substantially only for the situation of thorough boiling of the water to be achieved and not for accurate temperature measurement to take place at any temperature below that, empirical values, which can be stored in the controller 19 as explained above, can be used to further determine a certain continued run time for the induction heating coil 13*b* in the heating mode, the water in the cooking vessel 15 still not being completely thoroughly boiled after the continued run time has elapsed.

After a certain time, owing to the continued power input of the other three induction heating coils which advantageously takes place at the same or maximum power, the total or average temperature of all of the water reaches approximately 100° C., in particular after sufficient thorough mixing of the water which is heated by the cooking vessel base 16 above the heating coils with the rest of the water. If, then, in the right-hand region in FIG. 4, the thin and solid cycle signal of the measuring coil again has the gradient zero or becomes constant, all of the water 17 in the cooking vessel 15 is boiling. This also applies for the temperature $T_W$ of the water.

In the case of the water currents 23*a* and 23*b* illustrated by thick arrows in FIG. 2, it should be noted that sometimes large or even very large steam bubbles are also formed here, the steam bubbles rising upward. The steam bubbles also effect a large amount of the self-mixing of the water 17 in the cooking vessel 15.

On the basis of the description relating to FIGS. 1 to 3 and on the basis of the profiles in FIG. 4, it is also possible to easily imagine, as explained in the introductory part, how the heating mode of all of the induction heating coils, in particular also of the induction heating coil which is determined to be a subsequent measuring coil, is continued for a certain time after a constant cycle signal is reached by the measuring coil. The graph in FIG. 4 shows that it lasts for a certain time, for example 10 seconds to 40 seconds, after boiling of the water just above the cooking vessel base until all of the water in the cooking vessel is boiling.

That which is claimed:

1. A method for determination of a temperature in an induction hob, said induction hob comprising a plurality of induction heating coils, wherein said induction heating coils can be individually driven and, in a common heating mode, form a cooking point for a cooking vessel containing water, wherein said method comprises the following steps:

positioning a cooking vessel with a cooking vessel bottom containing water such that said cooking vessel covers at least two said induction heating coils by way of said cooking vessel base;

operating said induction heating coils in said common heating mode in order to bring said water in said cooking vessel to boil, this intending to be detected as temperature determination;

during said common heating mode, heating, by said induction heating coils, a region of said cooking vessel base being arranged above said induction heating coil;

during said common heating mode, detecting, by at least one said induction heating coil, an oscillation response indicating whether a temperature of said region of said cooking vessel base above said induction heating coil changes or increases with a temperature gradient;

operating said induction heating coils in said common heating mode at least until one said induction heating coil detects that said temperature gradient of said cooking vessel base above said induction heating coil is approaching zero or has reached zero;

determining at least one of said induction heating coils to be a measuring coil; and operating said measuring coil in a measuring mode and no longer in said common heating mode, with said measuring coil, in said measuring mode with a measuring power of up to a maximum of 50% of a maximum power of said induction heating coil, transmitting energy into said cooking vessel base for a short time and then detecting a fed-back oscillation response, with a time profile of said oscillation response being evaluated after several coupling-in operations of said measuring power, with said water in said cooking vessel being determined to be boiling in an event that said gradient of said time profile is approaching zero or has reached zero.

2. The method according to claim 1, wherein an induction heating coil which first has a temperature gradient reaching zero during said common heating mode is determined to be said measuring coil.

3. The method according to claim 1, wherein an induction heating coil which has a lowest power input into said cooking vessel is determined to be said measuring coil.

4. The method according to claim 1, wherein an induction heating coil which has a lowest degree of coverage by said cooking vessel is determined to be said measuring coil.

5. The method according to claim 1, wherein each of said induction heating coils are operated in said common heating mode at least until said temperature gradient of said cooking vessel base which is located above each of said induction heating coils has reached zero.

6. The method according to claim 1, wherein said measuring coil transmits energy into said cooking vessel base in said measuring mode with said measuring power for half a cycle, and then detects a fed-back oscillation response.

7. The method according to claim 1, wherein, after said first induction heating coil has or detects a temperature gradient which has reached zero, said heating mode of each of said induction heating coils, which operate in said common heating mode for said cooking vessel, is continued for at least 10 seconds at a constant power, with said previously determined measuring coil being operated in said measuring mode after said time elapses.

8. The method according to claim 7, wherein said heating mode of each of said induction heating coils, which operate in said heating mode for said cooking vessel, is continued for at least 30 seconds at a constant power.

9. The method according to claim 1, wherein, after each of said induction heating coils of said cooking point have a temperature gradient which has reached zero or have detected a temperature gradient which has reached zero, said common heating mode of each of said induction heating coils, which operate in said common heating mode for said cooking vessel, is continued for at least 10 seconds at a constant power.

10. The method according to claim 1, wherein, on a basis of values, which are stored in a memory, for a level of a total added power input of each of said induction heating coils, which are operated jointly as said cooking point in said common heating mode for a cooking vessel, into said cooking vessel and on a basis of a time until said temperature gradient of said first induction heating coil or said temperature gradient of said last induction heating coil has reached zero, a time for which said common heating mode is continued after said temperature gradient of said first induction heating coil or said last induction heating coil has reached zero up to a time at which one of said induction heating coils is operated as a measuring coil is determined.

11. The method according to claim 1, wherein, after a considerable reduction in said power at said measuring coil during said temperature determination by said measuring coil, a profile of a water temperature of water in said cooking vessel is set equal to a profile of said cycle duration at said measuring coil.

12. The method according to claim 1, wherein, after it is identified that said water in said cooking vessel is boiling, said power, of said induction heating coils or of said cooking point is reduced in order to prevent said water from boiling over.

13. The method according to claim 12, wherein said power of said induction heating coils or of said cooking point is reduced by at least 50%.

* * * * *